US009296094B2

(12) United States Patent
Su et al.

(10) Patent No.: US 9,296,094 B2
(45) Date of Patent: Mar. 29, 2016

(54) PNEUMATIC DRIVEN WRENCH

(71) Applicant: Basso Industry Corp., Taichung (TW)

(72) Inventors: San-Yih Su, Taichung (TW); Cheng-Wei Lai, Taichung (TW)

(73) Assignee: Basso Industry Corp., Taichung (TW)

( * ) Notice: Subject to any disclaimer, the term of this patent is extended or adjusted under 35 U.S.C. 154(b) by 514 days.

(21) Appl. No.: 13/903,949

(22) Filed: May 28, 2013

(65) Prior Publication Data

US 2013/0319714 A1 Dec. 5, 2013

(30) Foreign Application Priority Data

May 30, 2012 (TW) ..... 101119313 A

(51) Int. Cl.

| | |
|---|---|
| ***B25B 21/02*** | (2006.01) |
| ***B25B 21/00*** | (2006.01) |
| ***B25B 17/02*** | (2006.01) |
| *B27F 5/00* | (2006.01) |

(52) U.S. Cl.

CPC ..... *B25B 21/00* (2013.01); *B25B 17/02* (2013.01); *B25B 21/004* (2013.01); *B25B 21/02* (2013.01); *B27F 5/00* (2013.01)

(58) Field of Classification Search

CPC ..... B25B 17/00; B25B 17/02; B25B 21/00; B25B 21/02; B25B 21/004; B25B 21/005; B25B 13/46; B25B 23/1453; B23B 45/04; B27F 5/00; B27F 5/02; B23D 15/00

USPC ..... 173/218, 221, 93, 93.5, 93.6, 104, 168, 173/169, 170; 81/57.11, 57.13, 57.39

See application file for complete search history.

(56) References Cited

U.S. PATENT DOCUMENTS 4,418,764 A * 12/1983 Mizobe ..... B23Q 5/06 173/177
4,458,565 A * 7/1984 Zilly ..... B25B 23/147 173/178
5,142,952 A * 9/1992 Putney ..... B25B 21/004 81/57
5,293,747 A * 3/1994 Geiger ..... B25F 5/001 60/493
5,303,781 A * 4/1994 Lin ..... B25F 5/02 173/169
5,544,710 A * 8/1996 Groshans ..... B25B 21/02 173/176
6,062,323 A * 5/2000 Pusateri ..... B25B 21/02 173/169
6,902,011 B2 * 6/2005 Hall ..... B25B 23/1453 173/168
7,311,155 B2 * 12/2007 Chang ..... B25F 5/00 173/104
7,445,055 B2 * 11/2008 Pusateri ..... B25F 5/00 173/169
7,484,569 B2 * 2/2009 Kettner ..... B25B 21/02 173/176
7,594,549 B2 * 9/2009 Hua ..... B25B 21/00 173/104
7,886,840 B2 * 2/2011 Young ..... F01D 15/06 173/168
8,066,082 B2 * 11/2011 Tatsuno ..... B25B 23/145 173/169
8,267,190 B2 * 9/2012 Li ..... B23Q 5/00 173/104
8,480,453 B2 * 7/2013 Kobayashi ..... B25B 21/00 451/11
8,757,031 B2 * 6/2014 Su ..... B25B 21/004 81/57.11

* cited by examiner

*Primary Examiner* — Scott A. Smith
(74) *Attorney, Agent, or Firm* — The Mueller Law Office, P.C.

(57) ABSTRACT

A pneumatic driven wrench comprises: a housing defining a middle channel; a cylinder defining two fluid passages; a rotor; a first valve; a second valve driven by a valve-switching member for controlling fluid communication between the middle channel and a selected one of the fluid passages; a valve-triggering unit for driving the first valve; and a locking member driven by the valve-triggering unit to move between releasing and locking positions. The locking member engages one of the valve-switching member and the second valve when at the locking position. The locking member is disengaged from the one of the valve-switching member and the second valve when at the releasing position.

6 Claims, 13 Drawing Sheets

PNEUMATIC DRIVEN WRENCH

CROSS-REFERENCE TO RELATED APPLICATION

This application claims priority of Taiwanese Application No. 101119313, filed on May 30, 2012.

BACKGROUND OF THE INVENTION

1. Field of the Invention

This invention relates to a pneumatic driven wrench, more particularly to a pneumatic driven wrench with a mis-switching prevention capability.

2. Description of the Related Art

FIGS. 1 and 2 illustrate a conventional pneumatic driven wrench 1 including: an outer housing 10, an inner housing 11 that has first and second parts 111, 123 which are connected to each other and which respectively define an inlet channel 112 and a middle channel 124 for receiving a compressed air therein; a cylinder 12 that extends from the second part 123 and that defines a rotor chamber 120, a first fluid passage 126, and a second fluid passage (not shown), the first fluid passage 126 and the second fluid passage being in fluid communication with the rotor chamber 120; an annular valve 13 that is sleeved rotatably on the second part 123; a rotor 122 that is mounted rotatably in the rotor chamber 120 and that is driven to rotate by the compressed air flowing from the inlet channel 112 through the middle channel 124 and into the rotor chamber 120; an inlet valve 151 that is mounted in the second part 123 and that is disposed between the inlet channel 112 and the middle channel 124 for controlling fluid communication between the inlet channel 112 and the middle channel 124; a spring-biased trigger switch 15 pivoted to the outer housing 10 and connected to the inlet valve 151 for opening and closing the inlet valve 151; and an annular valve-rotating member 14 that is rotatably sleeved on the outer housing 10 and that is coupled to the annular valve 13 for driving rotation of the annular valve 13 between a first angular position (see FIG. 2), in which the annular valve 13 permits fluid communication between the middle channel 124 and the first fluid passage 126 while preventing fluid communication between the middle channel 124 and the second fluid passage, thereby permitting rotation of the rotor 122 relative to the cylinder 12 in a first rotational direction, and a second angular position (not shown), in which the annular valve 13 prevents fluid communication between the middle channel 124 and the first fluid passage 126 while permitting fluid communication between the middle channel 124 and the second fluid passage, thereby permitting rotation of the rotor 122 relative to the cylinder 12 in a second rotational direction opposite to the first rotational direction.

The conventional pneumatic driven wrench 1 is disadvantageous in that the annular valve-rotating member 14 can be accidentally rotated by a user to cause undesired rotation of the annular valve 13 between the first and second angular positions and thus undesired switching of the rotational directions of the rotor 122 while the rotor 122 is rotating in one of the first and second rotational directions, which can result in damage to the rotor 122 and a decrease in the service life of the pneumatic driven wrench 1.

SUMMARY OF THE INVENTION

Therefore, the object of the present invention is to provide a pneumatic driven wrench that can overcome the aforesaid drawback associated with the prior art.

According to this invention, there is provided a pneumatic driven wrench having a tool head that is rotatable for driving an object. The pneumatic driven wrench comprises: a housing having first and second sections and a middle section disposed between and interconnecting the first and second sections, the first section defining an inlet channel that is adapted to receive a compressed air therein, the middle section defining a middle channel; a cylinder mounted securely in the second section of the housing, having an inner surface that defines a cylinder chamber, and formed with first and second fluid passages that are in fluid communication with the cylinder chamber and that are angularly displaced from each other; a rotor mounted in the cylinder chamber and adapted to be driven by the compressed air to rotate relative to the cylinder in a first rotational direction when the compressed air passes through the first fluid passage and enters the cylinder chamber and in a second rotational direction when the compressed air passes through the second fluid passage and enters the cylinder chamber; a first valve mounted in the housing and movable between opened and closed positions for controlling fluid communication between the inlet channel and the middle channel; a direction-switching unit including a valve-switching member that is coupled to the housing, and a second valve that is mounted in the housing and that is driven by the valve-switching member to rotate relative to the housing between a first angular position, in which the second valve permits fluid communication between the middle channel and the first fluid passage while preventing fluid communication between the middle channel and the second fluid passage, and a second angular position, in which the second valve prevents fluid communication between the middle channel and the first fluid passage while permitting fluid communication between the middle channel and the second fluid passage; a valve-triggering unit supported on the housing, coupled to the first valve, and movable relative to the housing between a non-actuating position and an actuating position to drive movement of the first valve between the closed position and the opened position; and a locking member supported on the housing and driven by the valve-triggering unit to move between a releasing position and a locking position when the valve-triggering unit is moved between the non-actuating position and the actuating position. The locking member engages one of the valve-switching member and the second valve so as to prevent rotation of the second valve relative to the housing when the locking member is disposed at the locking position. The locking member is disengaged from said one of the valve-switching member and the second valve so as to permit rotation of the second valve relative to the housing when the locking member is disposed at the releasing position.

BRIEF DESCRIPTION OF THE DRAWINGS

In drawings which illustrate embodiments of the invention.

DETAILED DESCRIPTION OF THE PREFERRED EMBODIMENTS

Figure 1:
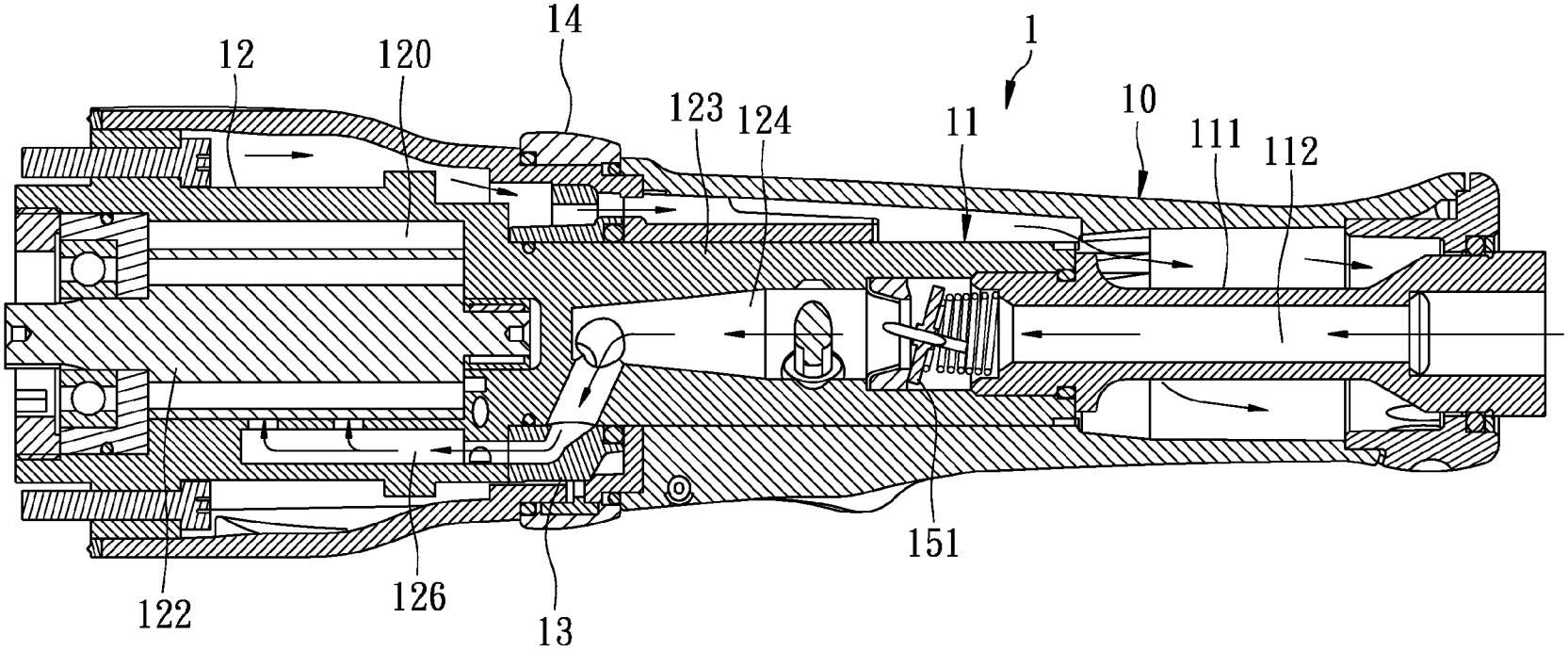
FIG. 1 PRIOR ART
FIG. 1 is a sectional view of a conventional pneumatic driven wrench.
Figure 2:
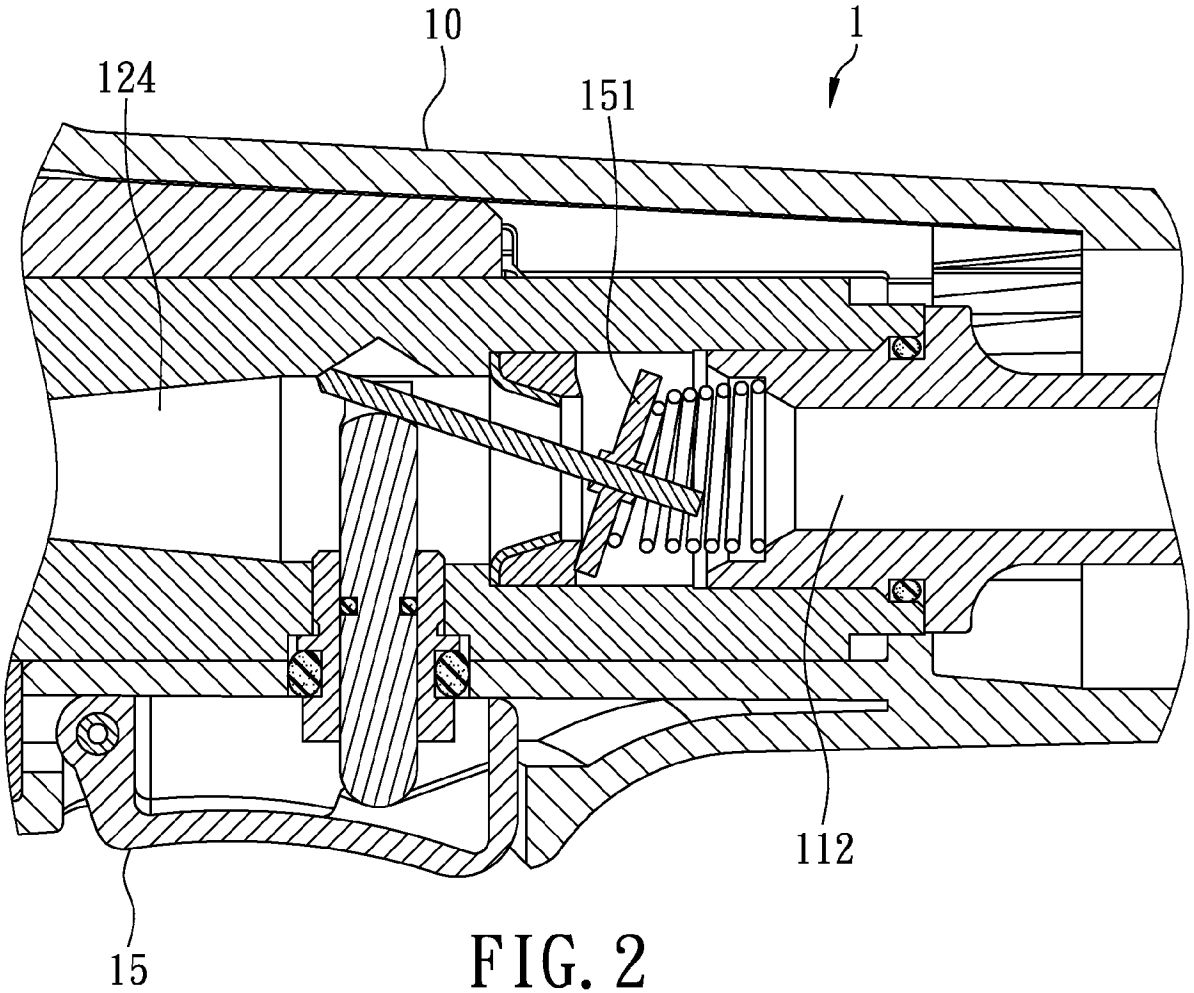
FIG. 2 PRIOR ART
FIG. 2 is an enlarged partly sectional view of the conventional pneumatic driven wrench.

Before the present invention is described in greater detail with reference to the accompanying preferred embodiments, it should be noted herein that like elements are denoted by the same reference numerals throughout the disclosure.

Figure 3:
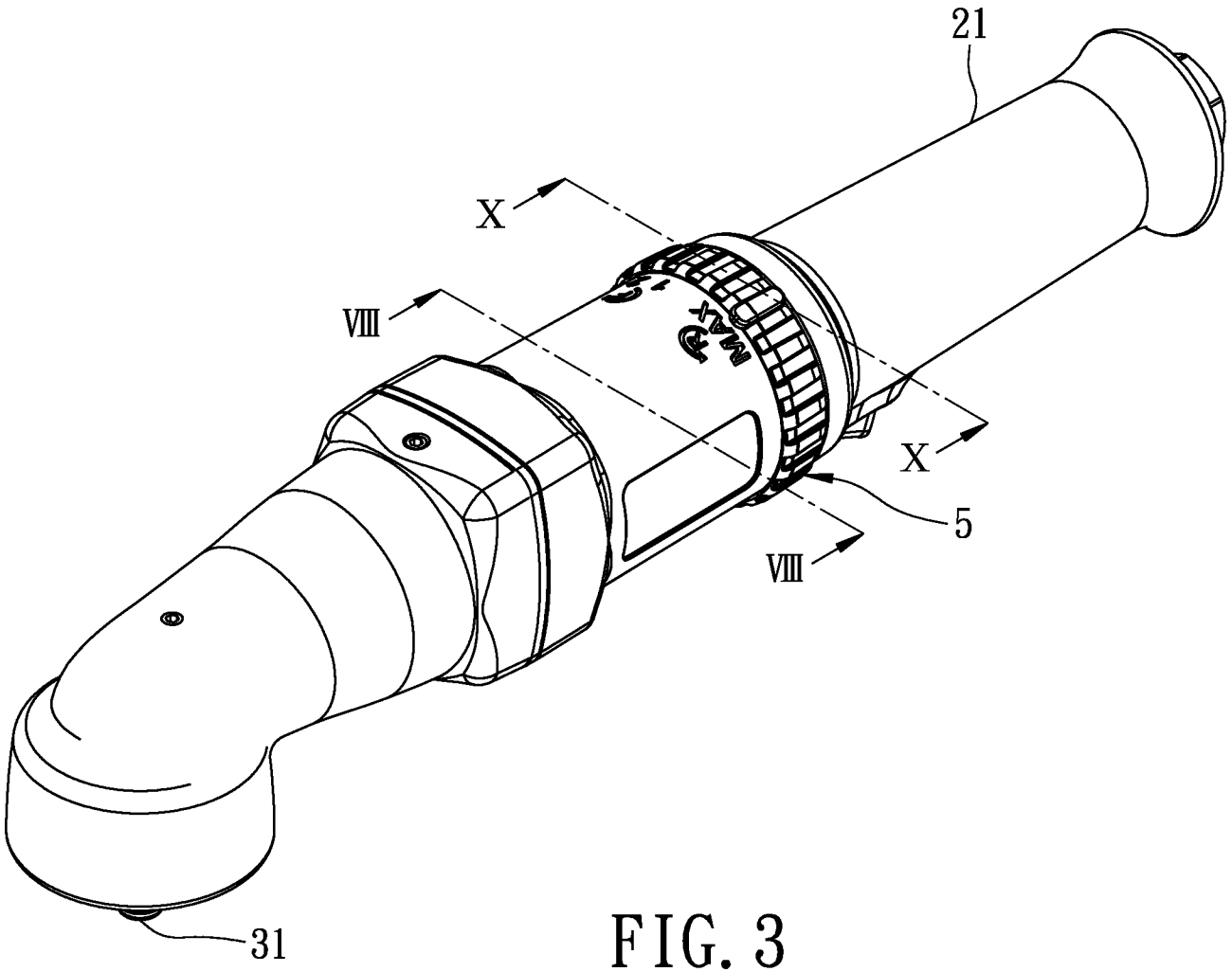
FIG. 3 is a perspective view of the first preferred embodiment of a pneumatic driven wrench according to the present invention.
Figure 4:
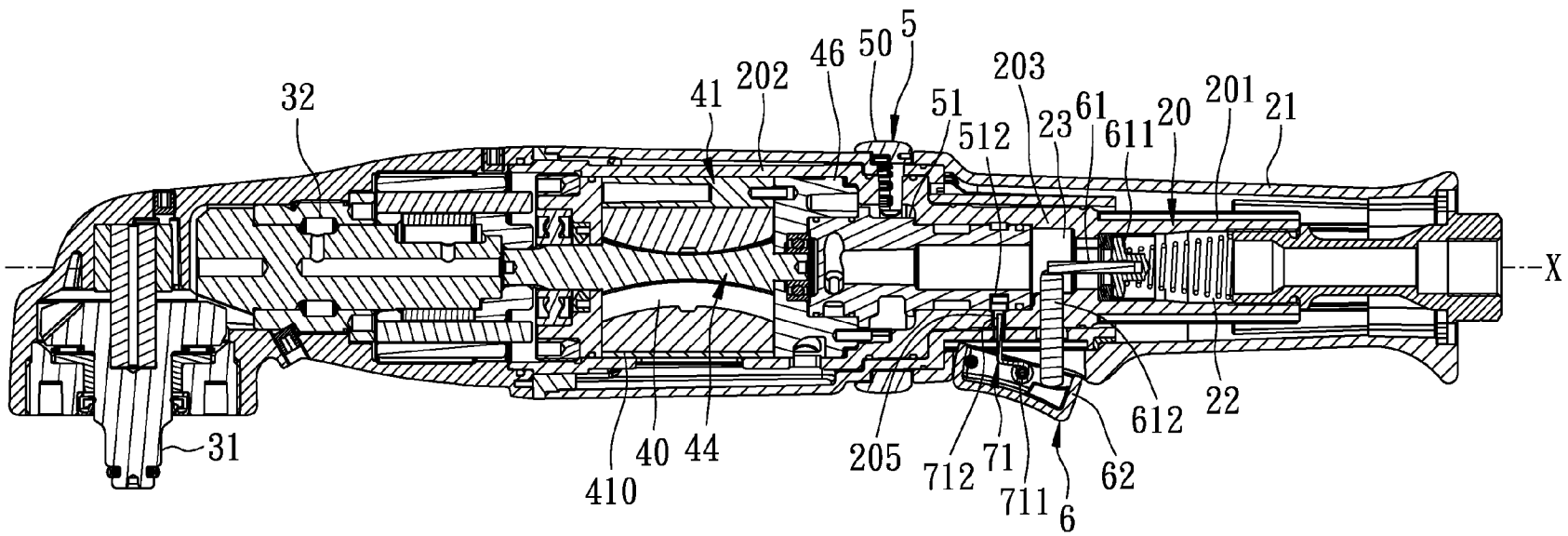
FIG. 4 is a sectional view of the first preferred embodiment.
Figure 5:
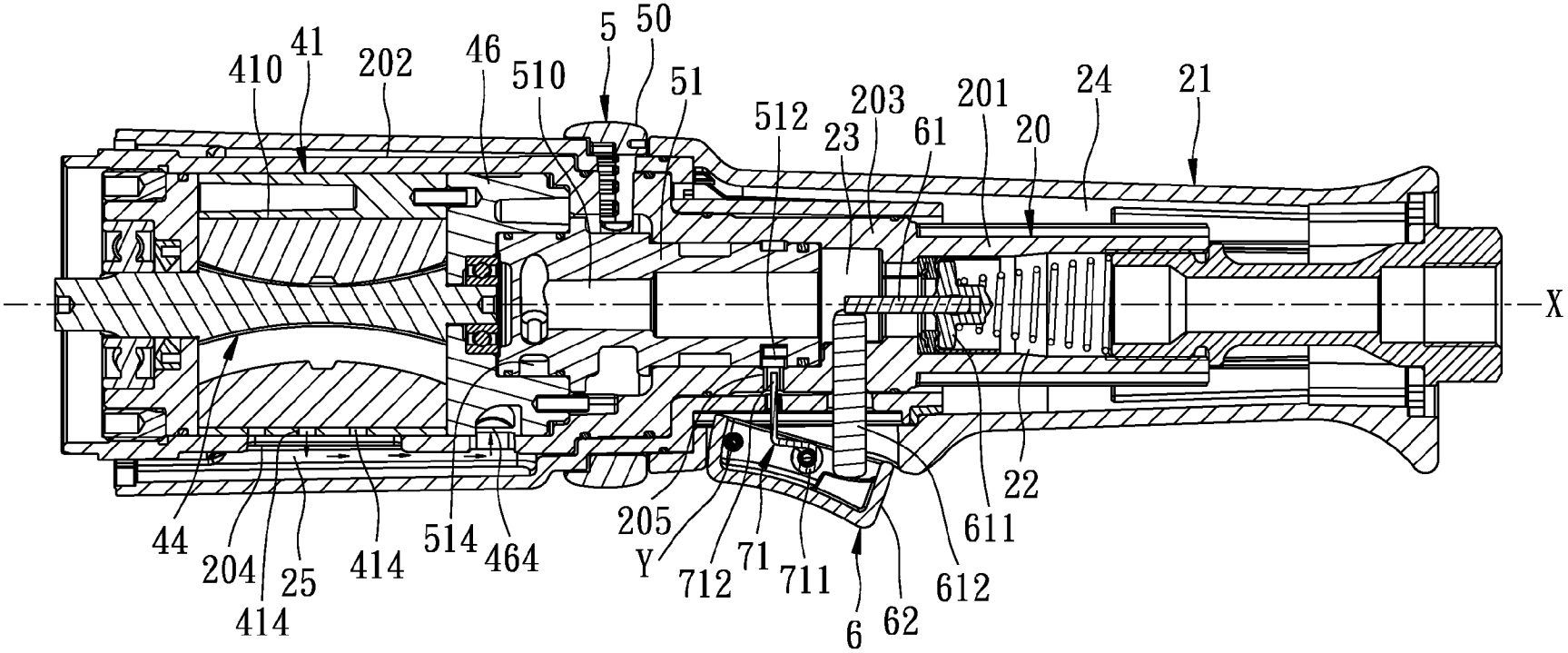
FIG. 5 is an enlarged view of a portion of the first preferred embodiment of FIG. 4.

FIGS. 3 to 5 illustrate the first preferred embodiment of a pneumatic driven wrench according to the present invention. The pneumatic driven wrench includes: an outer housing 21; an inner housing 20 disposed coaxially in the outer housing 21, a tool head 31 rotatable for driving an object (not shown), a transmission unit 32 mounted in the outer housing 21 and connected to the tool head 31, a cylinder 41, a rotor 44 connected to the transmission unit 32, a first valve 611, an annular valve seat 46, a direction-switching unit 5, a valve-triggering unit 6, and a locking member 71.

The inner housing 20 has first and second sections 201, 202 and a middle section 203 disposed between and interconnecting the first and second sections 201, 202. The first section 201 defines an inlet channel 22 that is adapted to receive a compressed air therein. The middle section 203 defines a middle channel 23.

Figure 6:
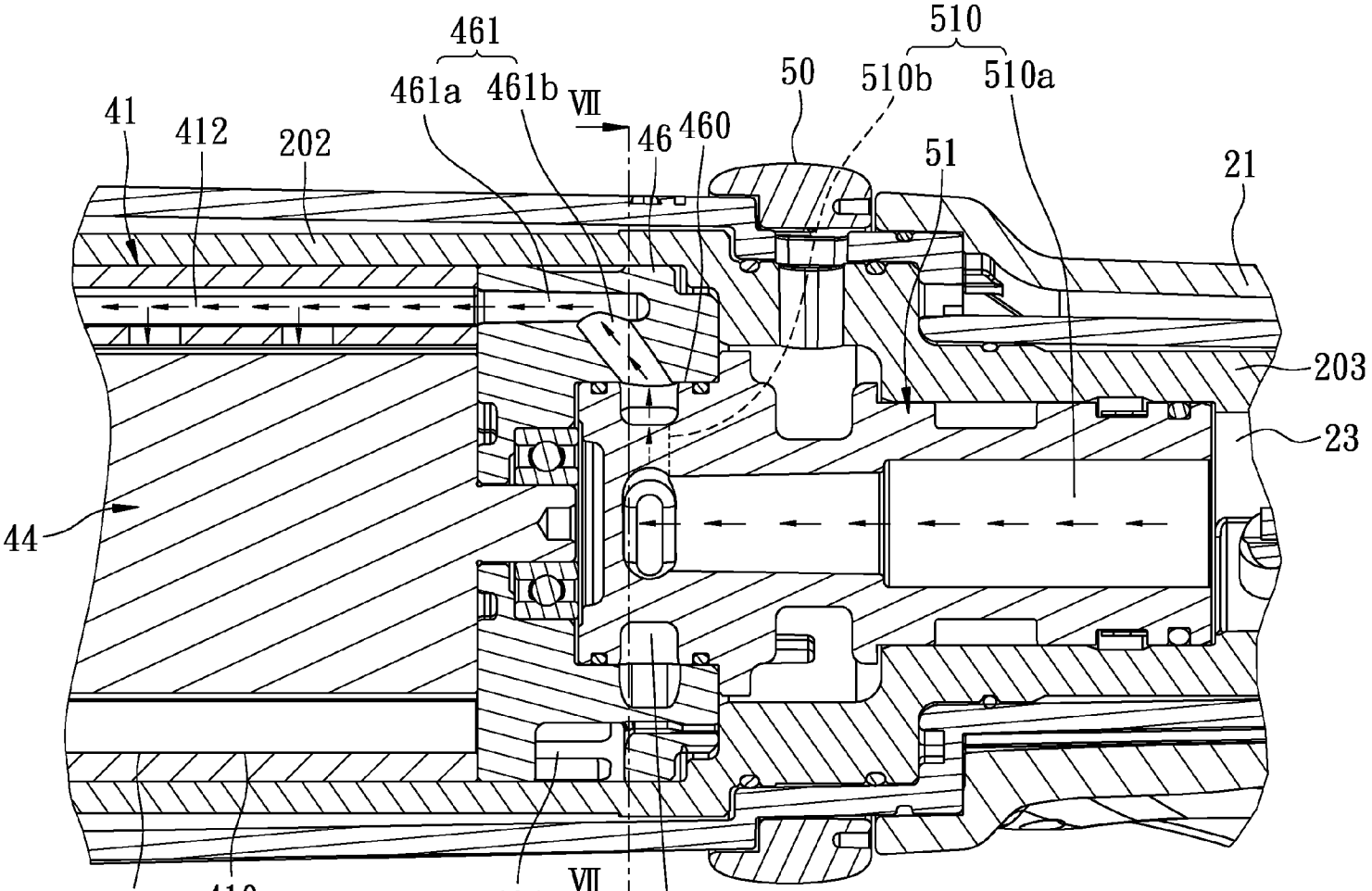
FIG. 6 is a fragmentary sectional view illustrating how a compressed air flows from an inlet channel into a fluid passage in a cylinder of the first preferred embodiment.
Figure 8:
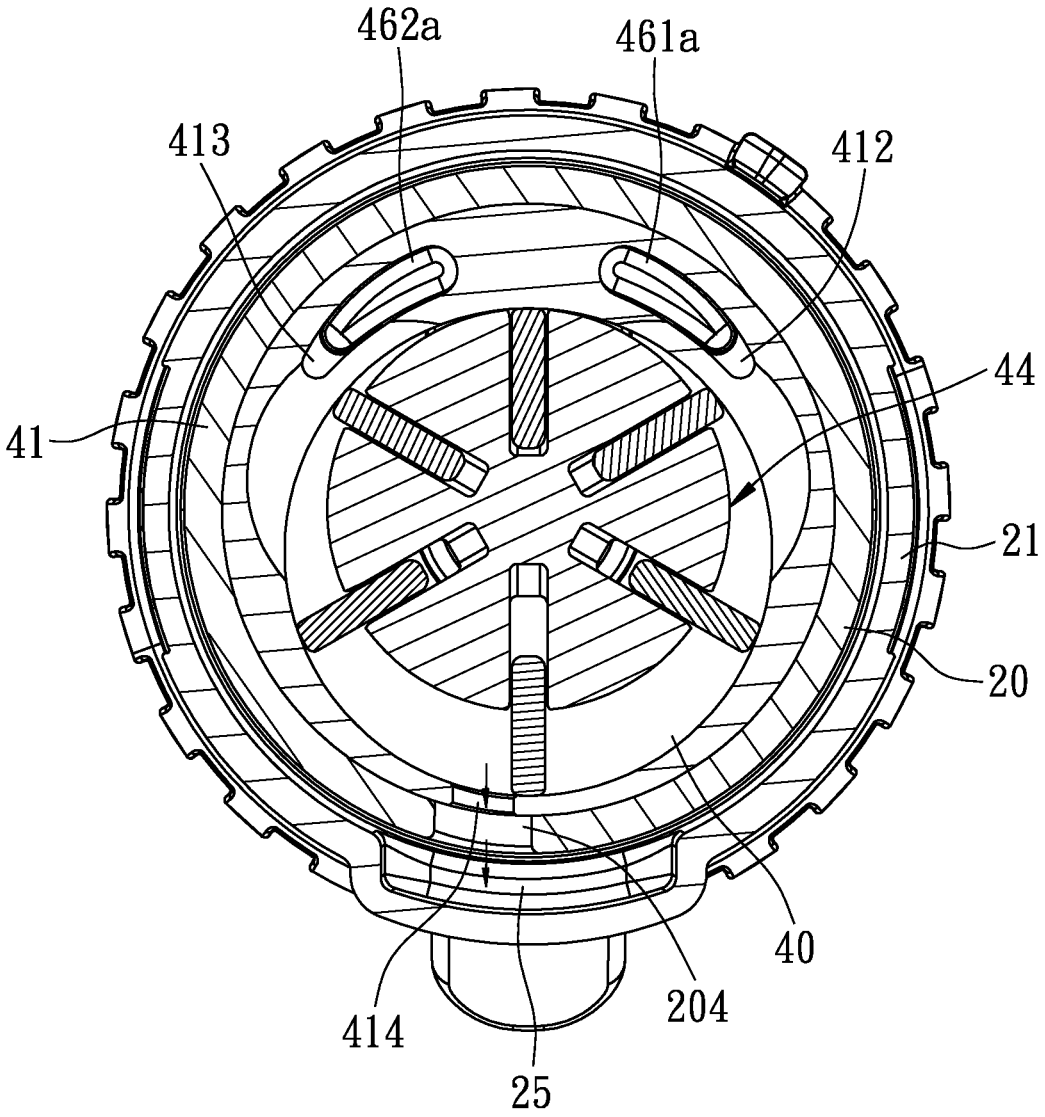
FIG. 8 is a sectional view taken along lines VIII-VIII in FIG. 3.

The cylinder 41 is mounted securely in the second section 202 of the inner housing 20, has an inner surface 410 that defines a cylinder chamber 40, and is formed with first and second fluid passages 412, 413 (see FIGS. 6 and 8) that are in fluid communication with the cylinder chamber 40 through wall holes (not shown) in the cylinder 41 and that are angularly displaced from each other.

The rotor 44 is mounted in the cylinder chamber 40, and is adapted to be driven by the compressed air to rotate about its axis relative to the cylinder 41 in a first rotational direction when the compressed air passes through the first fluid passage 412 and enters the cylinder chamber 40, and in a second rotational direction when the compressed air passes through the second fluid passage 413 and enters the cylinder chamber 40. The first and second rotational directions are opposite to each other.

Figure 11:
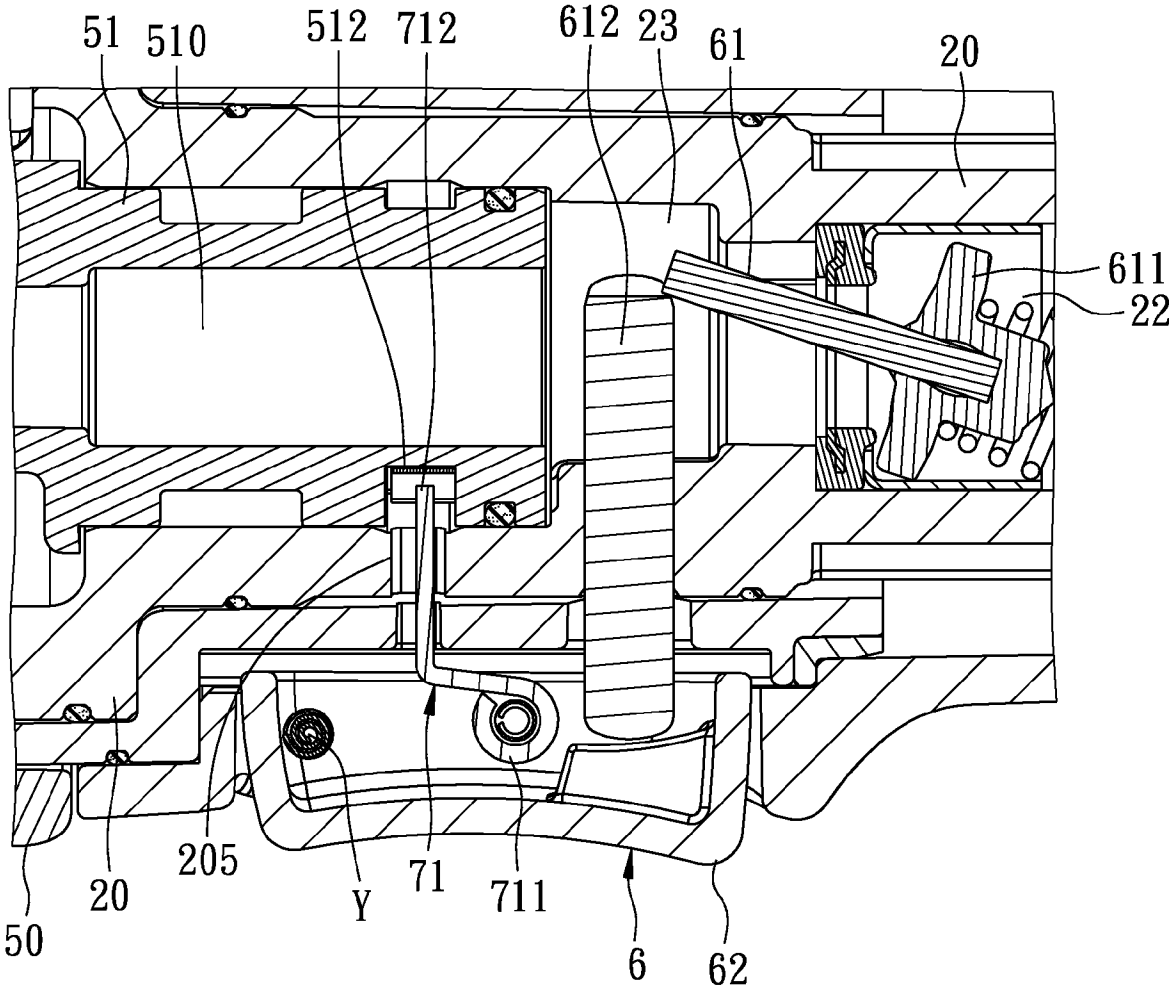
FIG. 11 is a fragmentary sectional view illustrating a state where a locking member of the first preferred embodiment is disposed at a locking position.

The first valve 611 is mounted in the inner housing 20, and is movable between closed and opened positions (see FIGS. 5 and 11) for controlling fluid communication between the inlet channel 22 and the middle channel 23.

Figure 7:
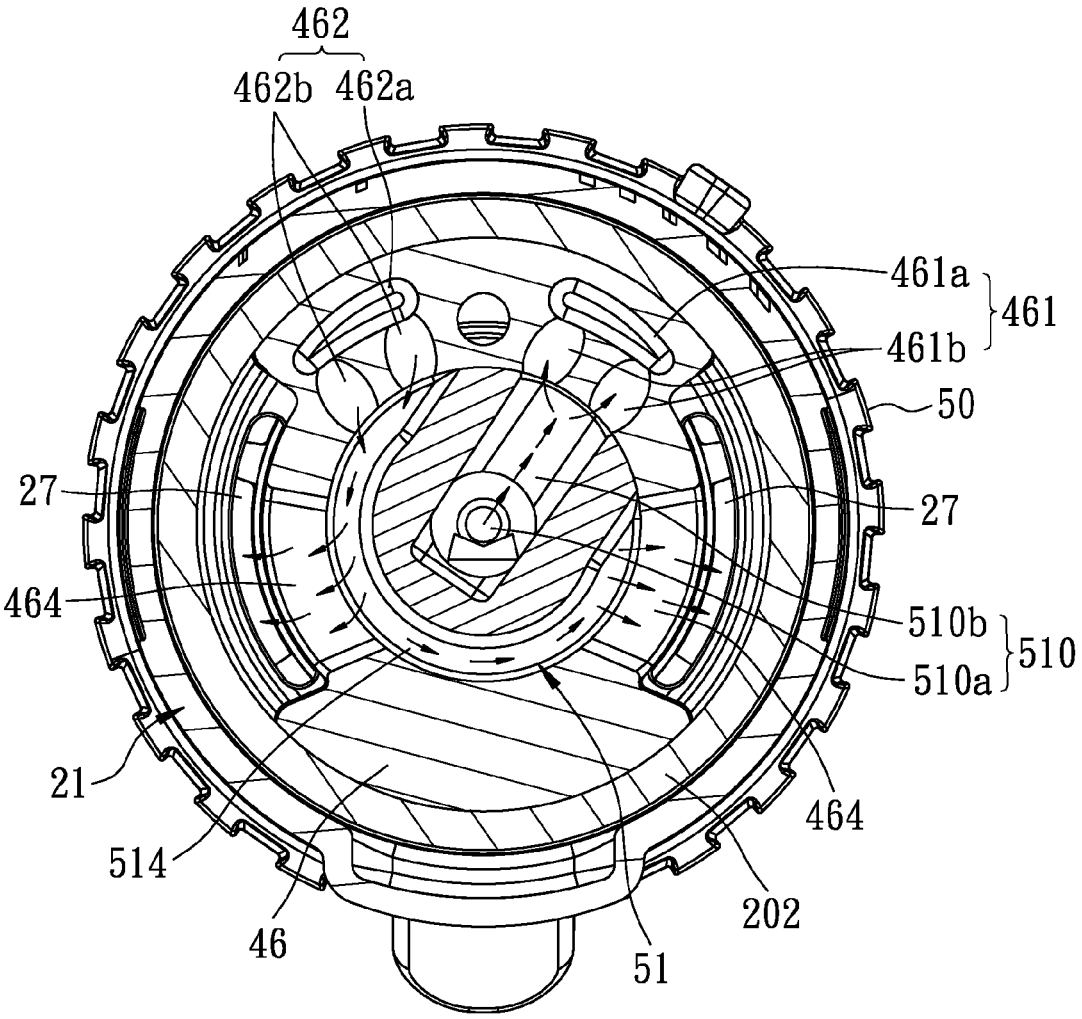
FIG. 7 is a sectional view taken along lines VII-VII in FIG. 6.
Figure 10:
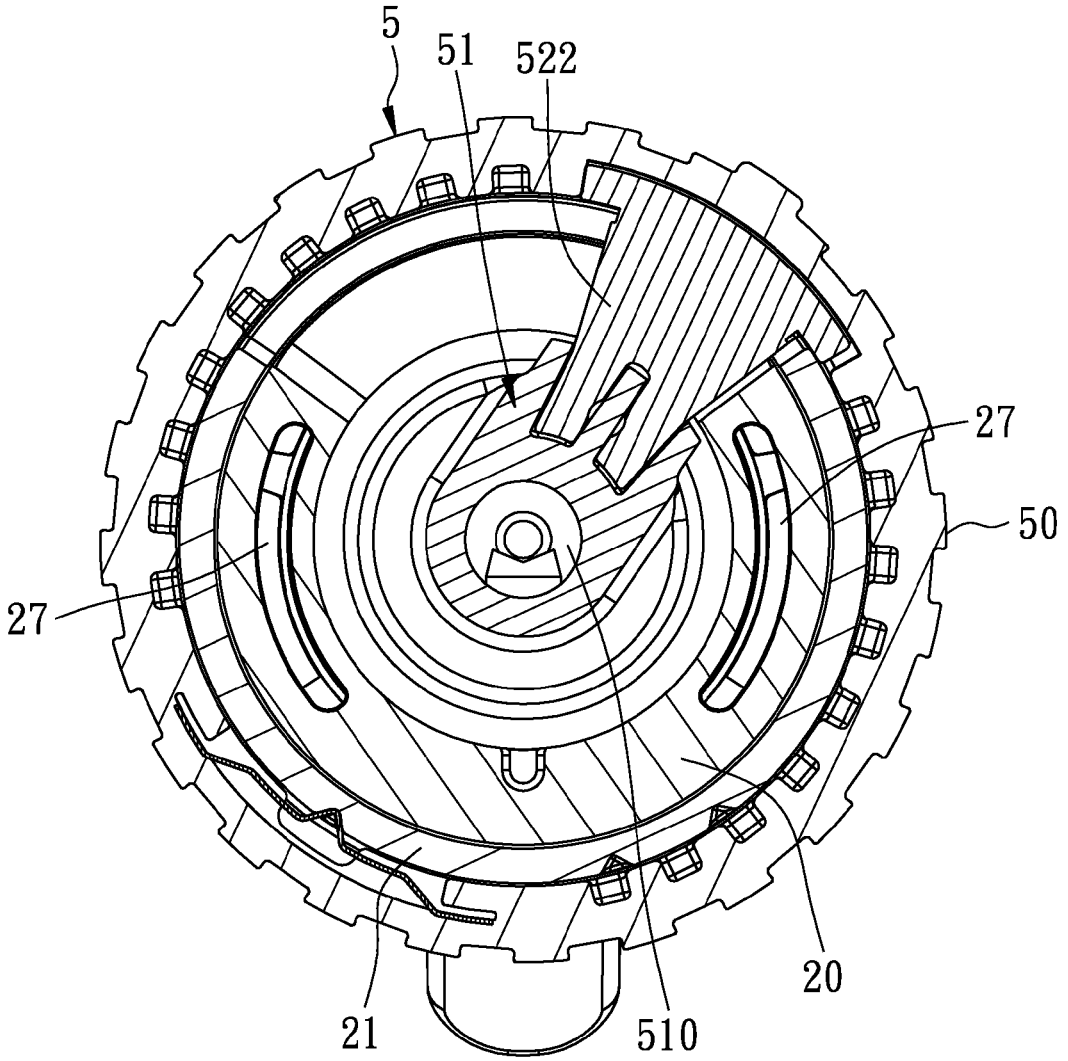
FIG. 10 is a sectional view taken along lines X-X in FIG. 3.

The direction-switching unit 5 includes a valve-switching member 50 that is supported on the inner housing 20 through the outer housing 21, an engaging tongue 522 (see FIG. 10) connected to and extending radially and inwardly from the valve-switching member 50, and a second valve 51 that is mounted in the inner housing 20. The valve-switching member 50 is annular in shape, is rotatably sleeved around the inner housing 20 through the outer housing 21, and is rotatable relative to the inner housing 20 about a central axis (X). The second valve 51 engages the engaging tongue 522 so as to be driven by the valve-switching member 50 to rotate about its axis relative to the inner housing 20 between a first angular position (see FIGS. 6 and 7), in which the second valve 51 permits fluid communication between the middle channel 23 and the first fluid passage 412 while preventing fluid communication between the middle channel 23 and the second fluid passage 413, and a second angular position (not shown), in which the second valve 51 prevents fluid communication between the middle channel 23 and the first fluid passage 412 while permitting fluid communication between the middle channel 23 and the second fluid passage 413.

The annular valve seat 46 is secured to the cylinder 41, and is disposed between the cylinder 41 and the second valve 51. The valve seat 46 defines a central recess 460 and first and second conduits 461, 462 (see FIGS. 6, 7 and 8) that are respectively in fluid communication with the first and second fluid passages 412, 413. Each of the first and second conduits 461, 462 has an axial section 461*a*, 462*a* and two inclined sections 461*b*, 462*b*. The second valve 51 extends into the central recess 460, and defines a valve channel 510 that has an axial segment 510*a* and a radial segment 510*b* in fluid communication with the axial segment 510*a* (see FIGS. 6 and 7). The radial segment 510*b* is in fluid communication with the inclined sections 461*b* of the first conduit 461 when the second valve 51 is disposed at the first angular position (see FIG. 7) and is in fluid communication with the inclined sections 462*b* of the second conduit 462 when the second valve 51 is disposed at the second angular position (not shown). The second valve 51 is formed with a circumferentially extending groove 514 that extends in a circumferential direction with respect to the axial segment 510*a* of the valve channel 510, that is in fluid communication with the inclined sections 462*b* of the second conduit 462 when the second valve 51 is disposed at the first angular position (see FIG. 7), and that is in fluid communication with the inclined sections 461*b* of the first conduit 461 when the second valve 51 is disposed at the second angular position (not shown).

Figure 9:
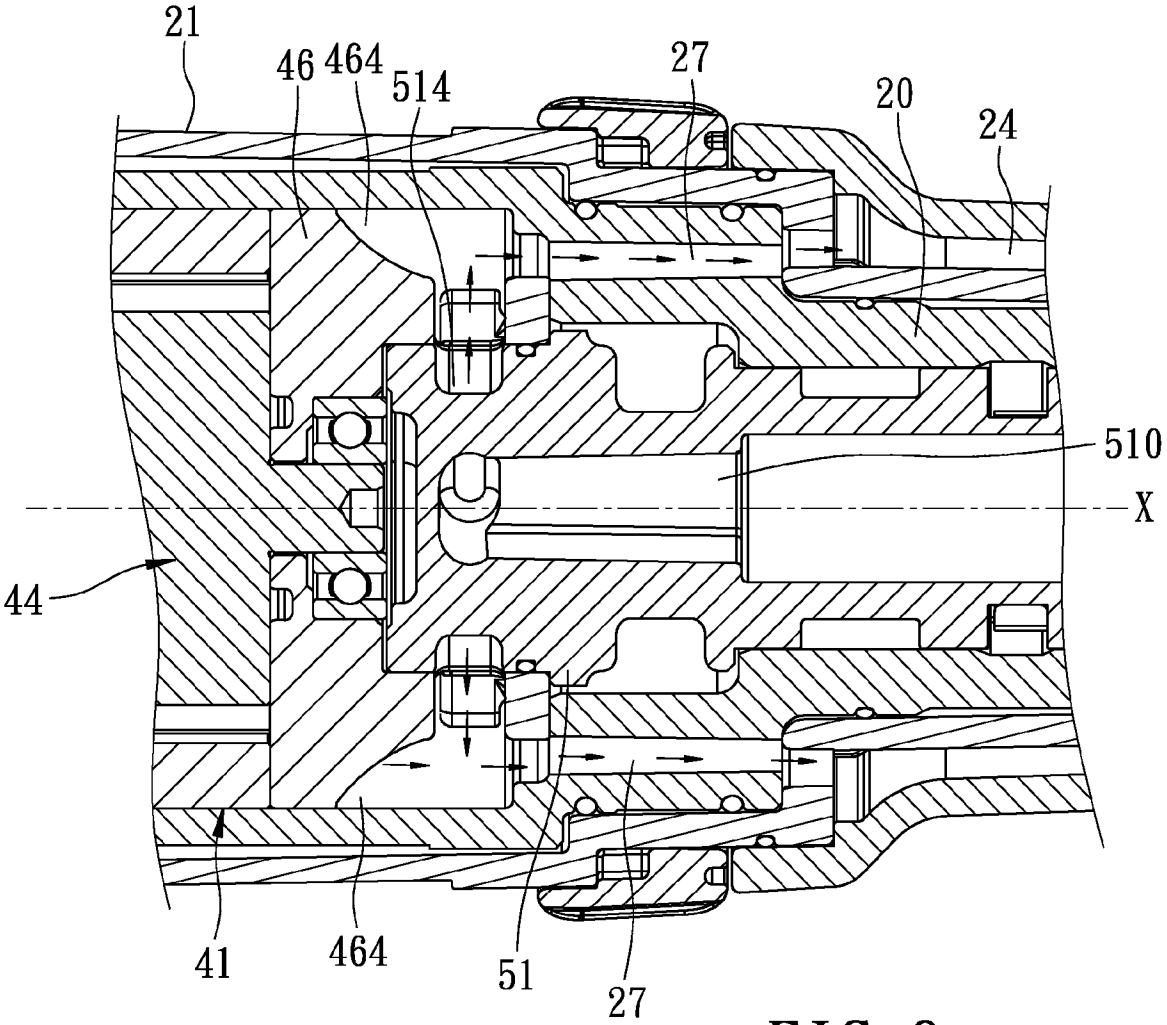
FIG. 9 is a fragmentary sectional view illustrating how the compressed air flows from a valve into an exhaust passage in the first preferred embodiment.

The cylinder 41 is further formed with a plurality of exhaust holes 414 (see FIGS. 5 and 8) in fluid communication with the rotor chamber 40. The inner and outer housings 20, 21 cooperatively define an exhaust passage 24 and a throttle passage 25 (see FIG. 5), which are disposed adjacent to the inlet channel 22 and the rotor chamber 40, respectively. The inner housing 20 is formed with a slot 204 (see FIGS. 5 and 8) that is in fluid communication with the exhaust holes 414 and the throttle passage 25, and two interconnecting passages 27 (see FIGS. 9 and 10) that are in fluid communication with the exhaust passage 24. The valve seat 46 further defines two openings 464 (see FIGS. 5, 6 and 9) that are in fluid communication with the circumferentially extending groove 514. The interconnecting passages 27 are in fluid communication with the openings 464, respectively.

The valve-triggering unit 6 is supported on the inner housing 20 through the outer housing 21, is coupled to the first valve 611, and is movable relative to the inner housing 20 between a non-actuating position (see FIG. 5) and an actuating position (see FIG. 11) to drive movement of the first valve 611 between the closed position and the opened position. In this embodiment, the valve-triggering unit 6 includes a trigger switch 62 that is supported on the inner housing 20 through the outer housing 21 and that is pivoted to the outer housing 21 so as to be rotatable relative to the inner housing 20 about a switch axis (Y) transverse to the central axis (X).

The trigger switch 62 has one end that is pivoted to the outer housing 21, and an opposite end that is connected to the first valve 611 through a valve rod 61 and a pushing rod 612 so that rotation of the trigger switch 62 about the switch axis (Y) drives movement of the first valve 611 between the closed position and the opened position. The valve rod 61 is securely connected to the first valve 611. The pushing rod 611 extends movably into the inner housing 20 in a direction transverse to the central axis (X) and the switch axis (Y), and interconnects the trigger switch 62 and the valve rod 61.

The flow paths of the compressed air during operation of the pneumatic driven wrench are described as follows. When the second valve 51 is rotated to the first angular position (see FIGS. 6 and 7), the compressed air is permitted to flow from the valve channel 510 through the first conduit 461 and the first fluid passage 412 (see FIG. 6), enters into the rotor chamber 40, is exhausted from the rotor chamber 40 to drive the rotor to rotate in the first rotational direction, and is subsequently discharged to the outside of the outer housing 21 through a first exhaust path that includes the second fluid passage 413, the second conduit 462 (see FIG. 7), the circumferentially extending groove 514, the openings 464, the interconnecting passages 27 (see FIG. 9) and the exhaust passage 24, and a second exhaust path that includes the exhaust holes 414 (see FIGS. 5 and 8), the slot 204, the throttle passage 25, the openings 464, the interconnecting passages 27 and the exhaust passage 24. In a similar manner, when the second valve 51 is rotated to the second angular position (not shown), the compressed air is permitted to flow from the valve channel 510 through the second conduit 462 and the second fluid passage 413, enters into the rotor chamber 40, is exhausted from the rotor chamber 40 to drive the rotor to rotate in the second rotational direction, and is subsequently discharged to the outside of the outer housing 21 through a third exhaust path that includes the first fluid passage 412, the first conduit 461, the circumferentially extending groove 514, the openings 464, the interconnecting passages 27 and the exhaust passage 24, and a fourth exhaust path that includes the exhaust holes 414, the slot 204, the throttle passage 25, the openings 464, the interconnecting passages 27 and the exhaust passage 24.

The locking member 71 is supported on the inner housing 20 through the outer housing 21, and is driven by the valve-triggering unit 6 to move between a releasing position (see FIG. 5) and a locking position (see FIG. 11) when the valve-triggering unit 6 is moved between the non-actuating position and the actuating position. The locking member 71 engages the second valve 51 so as to prevent rotation of the second valve 51 relative to the inner housing 20 when the locking member 71 is disposed at the locking position. As such, when the trigger switch 62 is pressed and is held at the actuating position, the second valve 51 is locked against rotation, thereby preventing mis-switching or undesired switching of the rotational direction of the rotor 44. The locking member 71 is disengaged from the second valve 51 so as to permit rotation of the second valve 51 relative to the inner housing 20 when the locking member 71 is disposed at the releasing position.

In this embodiment, the second valve 51 is formed with an engaging hole 512 (see FIGS. 5 and 11), and the locking member 71 is in the form of a pin and has a pivot end 711 which is pivoted to the trigger switch 62 and an engaging end 712 which is disposed in the engaging hole 512 when the locking member 71 is disposed at the locking position and which is disposed outwardly of the engaging hole 512 when the locking member 71 is disposed at the releasing position. The locking member 71 has a section extending in a radial direction with respect to the axis of the second valve 51 into a guiding through-hole 205 in the inner housing 20 (see FIG. 5).

Figure 12:
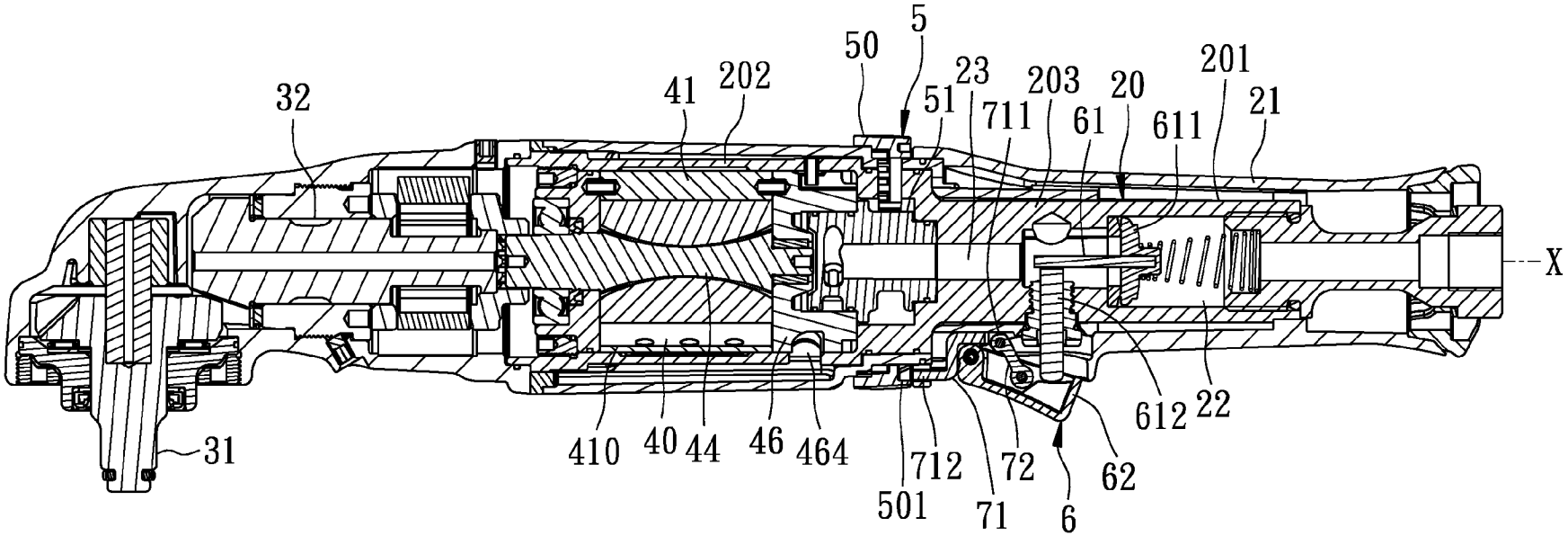
FIG. 12 is a sectional view of the second preferred embodiment of the pneumatic driven wrench according to the present invention.
Figure 13:
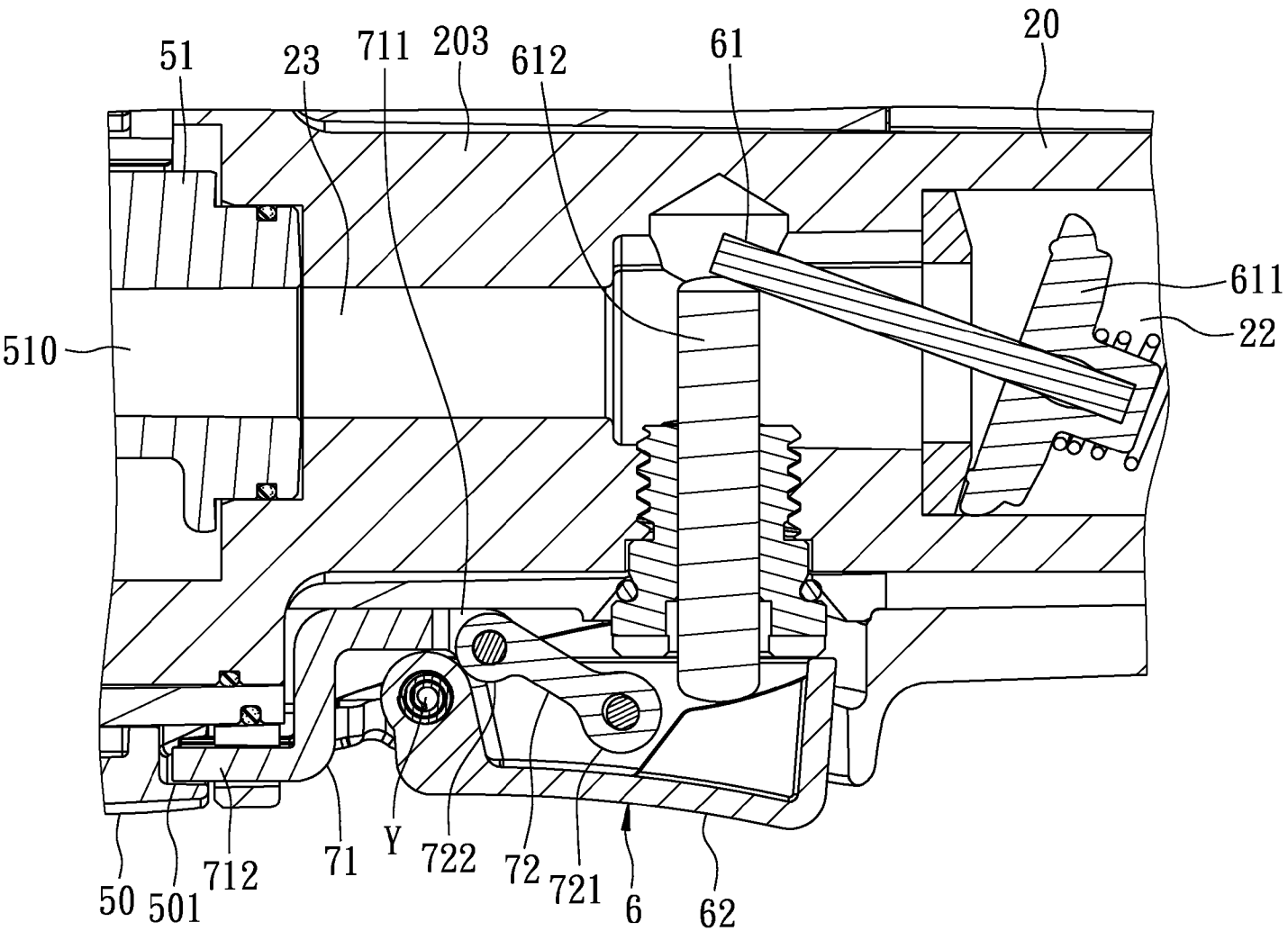
FIG. 13 is a fragmentary sectional view illustrating a state where a locking member of the second preferred embodiment is disposed at a locking position.

FIGS. 12 and 13 illustrate the second preferred embodiment of the pneumatic driven wrench according to the present invention. The second preferred embodiment differs from the previous embodiment mainly in that the locking member 71 of the second preferred embodiment is designed to engage and disengage the valve-switching member 50 instead of the second valve 51.

In this embodiment, the valve-switching member 50 is formed with an engaging hole 501. The locking member 71 is in the form of a bent plate, is slidable along a direction parallel to the central axis (X), and has a driven end 711 that is driven by the valve-triggering unit 6, and an engaging end 712 that is disposed in the engaging hole 501 when the locking member 71 is disposed at the locking position, thereby preventing rotation of the valve-switching member 50 relative to the inner housing 20, and that is disposed outwardly of the engaging hole 501 when the locking member 71 is disposed at the releasing position, thereby permitting rotation of the valve-switching member 50 relative to the inner housing 20.

In this embodiment, the valve-triggering unit 6 further includes a linkage 72 that has first and second ends 721, 722 which are respectively pivoted to the trigger switch 62 and the driven end 711 of the locking member 71 so that rotation of the trigger switch 62 can drive movement of the locking member 71 through the linkage 72.

With the inclusion of the locking member 71 and the design of connecting the locking member 71 to the valve-triggering unit 6 in the pneumatic driven wrench of this invention, the aforesaid drawback associated with the prior art can be eliminated.

While the present invention has been described in connection with what are considered the most practical and preferred embodiments, it is understood that this invention is not limited to the disclosed embodiments but is intended to cover various arrangements included within the spirit and scope of the broadest interpretation and equivalent arrangements.

What is claimed is:

1. A pneumatic driven wrench having a tool head that is rotatable for driving an object, said pneumatic driven wrench comprising:

a housing having first and second sections and a middle section disposed between and interconnecting said first and second sections, said first section defining a inlet channel that is adapted to receive a compressed air therein, said middle section defining a middle channel;

a cylinder mounted securely in said second section of said housing, having an inner surface that defines a cylinder chamber, and formed with first and second fluid passages that are in fluid communication with said cylinder chamber and that are angularly displaced from each other;

a rotor mounted in said cylinder chamber and adapted to be driven by the compressed air to rotate relative to said cylinder in a first rotational direction when the compressed air passes through said first fluid passage and enters said cylinder chamber and in a second rotational direction when the compressed air passes through said second fluid passage and enters said cylinder chamber;

a first valve mounted in said housing and movable between opened and closed positions for controlling fluid communication between said inlet channel and said middle channel;

a direction-switching unit including a valve-switching member that is supported on said housing, and a second valve that is mounted in said housing and that is driven by said valve-switching member to rotate relative to said housing between a first angular position, in which said second valve permits fluid communication between said middle channel and said first fluid passage while preventing fluid communication between said middle channel and said second fluid passage, and a second angular position, in which said second valve prevents fluid communication between said middle channel and said first fluid passage while permitting fluid communication between said middle channel and said second fluid passage;

a valve-triggering unit supported on said housing, coupled to said first valve, and movable relative to said housing between a non-actuating position and an actuating position to drive movement of said first valve between the closed position and the opened position; and a locking member supported on said housing and driven by said valve-triggering unit to move between a releasing position and a locking position when said valve-triggering unit is moved between the non-actuating position and the actuating position, said locking member engaging one of said valve-switching member and said second valve so as to prevent rotation of said second valve relative to said housing when said locking member is disposed at the locking position, said locking member being disengaged from said one of said valve-switching member and said second valve so as to permit rotation of said second valve relative to said housing when said locking member is disposed at the releasing position.

2. The pneumatic driven wrench of claim 1, wherein said valve-switching member is rotatably sleeved around said housing, is rotatable relative to said housing about a central axis, and is formed with an engaging hole, said locking member being in the form of a bent plate, being slidable along a direction parallel to said central axis, and having a driven end that is driven by said valve-triggering unit, and an engaging end that is disposed in said engaging hole when said locking member is disposed at the locking position and that is disposed outwardly of said engaging hole when said locking member is disposed at the releasing position.

3. The pneumatic driven wrench of claim 2, wherein said valve-triggering unit includes a trigger switch that is supported on said housing and that is rotatable relative to said housing about a switch axis transverse to said central axis, and a linkage that has first and second ends which are respectively pivoted to said trigger switch and said driven end of said locking member so that rotation of said trigger switch can drive movement of said locking member through said linkage, said trigger switch being connected to said first valve in such a manner that rotation of said trigger switch about the switch axis drives movement of said first valve between the closed position and the opened position.

4. The pneumatic driven wrench of claim 3, wherein said valve-triggering unit further includes a valve rod that is connected to said first valve, and a pushing rod that interconnects said trigger switch and said valve rod.

5. The pneumatic driven wrench of claim 1, wherein said valve-triggering unit includes a trigger switch that is supported on said housing and that is rotatable relative to said housing about a switch axis transverse to said central axis, said trigger switch being connected to said first valve in such a manner that rotation of said trigger switch about the switch axis drives movement of said first valve between the closed position and the opened position, said second valve being formed with an engaging hole, said locking member being in the form of a pin and having a pivot end that is pivoted to said trigger switch, and an engaging end, said engaging end of said locking member being disposed in said engaging hole when said locking member is disposed at the locking position and being disposed outwardly of said engaging hole when said locking member is disposed at the releasing position.

6. The pneumatic driven wrench of claim 1, further comprising an annular valve seat secured to said cylinder and disposed between said cylinder and said second valve, said valve seat defining a central recess and first and second conduits that are respectively in fluid communication with said first and second fluid passages, said second valve extending into said central recess and defining a valve channel that is in fluid communication with said first conduit when said second valve is disposed at the first angular position and that is in fluid communication with said second conduit when said second valve is disposed at the second angular position.

* * * * *